United States Patent [19]

Bartimote

[11] Patent Number: 4,996,999

[45] Date of Patent: Mar. 5, 1991

[54] MATERIAL HANDLING APPARATUS AND METHOD

[76] Inventor: John K. Bartimote, 54 Allen Crescent, Traralong 3844, Victoria, Australia

[21] Appl. No.: 279,666

[22] PCT Filed: Apr. 13, 1987

[86] PCT No.: PCT/AU87/00098

§ 371 Date: Oct. 14, 1988

§ 102(e) Date: Oct. 14, 1988

[87] PCT Pub. No.: WO87/06162

PCT Pub. Date: Oct. 22, 1987

[30] Foreign Application Priority Data

Apr. 16, 1986 [AU] Australia ..... PH5482
Sep. 2, 1986 [AU] Australia ..... PH7812

[51] Int. Cl.[5] ..... B08B 3/00

[52] U.S. Cl. ..... 134/111; 134/122 R; 312/1

[58] Field of Search ..... 134/111, 122 R, 200; 312/1, 3

[56] References Cited

U.S. PATENT DOCUMENTS

| | | | |
|---|---|---|---|
| 2,954,968 | 10/1960 | Vedder | 263/50 |
| 4,304,224 | 12/1981 | Fortney | 312/3 X |
| 4,541,846 | 9/1985 | Sjodin | 55/97 |
| 4,561,903 | 12/1985 | Blaul | 134/111 X |
| 4,567,818 | 2/1986 | Napadow | 98/115.2 |
| 4,784,169 | 11/1988 | Striedieck | 134/111 |
| 4,812,700 | 3/1989 | Natale | 312/1 |

*Primary Examiner*—Charles Hart
*Attorney, Agent, or Firm*—Fleit, Jacobson, Cohn, Price, Holman & Stern

[57] ABSTRACT

Apparatus for handling potentially dangerous materials such as asbestos comprising a main body portion (3) having a work zone (5) therein into which, in use, the material can be placed. An opening (7) is provided to enable access to the work zone (5) from externally thereof. The apparatus further includes spray means (8) operatively mounted to the main body (3) and operatively connectible to a fluid source. The spray means (8) comprises a plurality of spray heads (8, 8A, 8B, 8C) arranged so as to form a plurality of fluid barriers or curtains which surround the work zone (5) and means (16) is provided for maintaining a pressure differential between said work zone and externally thereof when the apparatus is in use.

10 Claims, 5 Drawing Sheets

MATERIAL HANDLING APPARATUS AND METHOD

This invention relates generally to a method and apparatus for handling material and, more particularly, though not exclusively to materials of a fibrous or particulate nature and to articles including such materials.

One particular application of the present invention relates to the handling of asbestos and it will be convenient to hereinafter describe the invention with reference to that particular application. It is to be understood, however, that this is not to be taken as a limitation on the scope of the invention.

Asbestos is a material which was used extensively as an insulator such as, for example, for insulating pipes and the like. The dangers to health and environment of asbestos have become well documented and, as such, there has been strong moves to limit the use of asbestos and also remove it from areas where it could constitute a health or environmental hazard. In the handling of asbestos, elaborate and relatively expensive work procedures have to be followed which include the wearing of special clothing and breathing apparatus as well as the expensive exhaust systems and filtering systems.

It is an object of the present invention to provide a method and apparatus for handling materials which is relatively simple and cheap.

According to the present invention there is provided apparatus for handling potentially dangerous materials comprising a main body portion having a work zone therein into which, in use, the material can be placed, an opening providing access to said work zone from externally thereof, spray means operatively mounted to said main body and operatively connectible to fluid source characterized in that said spray means comprising a plurality of spray heads arranged so as to form a plurality of fluid barriers or curtains which surround said work zone and means is provided for maintaining a pressure differential between said work zone and externally thereof when the apparatus is in use.

Preferably the body portion comprises a frame which includes a plurality of elongated elements the frame being adapted to support the spray means, and a catchment section for collecting fluid discharged by the spray means, the catchment section also collecting material being worked upon in the work zone. Preferably the catchment section comprises a flexible screen which is suspended from the frame of the main body.

The apparatus may further include a discharge outlet form which the fluid can be discharged from the work zone.

Preferably the spray means comprises a primary configuration which includes one or more spray heads which are adapted so that, in use, the spray pattern forms a barrier or curtain across the access opening to the work zone, and one or more additional configurations comprising one or more spray heads are provided the or each spray head in each additional configuration being adapted in use so that the spray pattern forms a barrier or curtain at selected peripheral planes about the work zone, the various configurations being arranged to completely encase the work zone.

Preferably the means for maintaining a pressure differential between the work zone externally thereof, a vacuum pump which is operatively connected to the work zone.

Preferably the apparatus further includes a holding tank operatively connected to said discharge outlet, filter means within said holding tank for filtering solid particles from the liquid and pump means for returning liquid to the spray means.

Further the preferred form of the apparatus includes an interceptor for receiving liquid/solid/dust particles drawn from the work zone by the vacuum pump. The interceptor including a prefilter zone for collecting solid particles a second filter zone for separating the liquid in the stream from solid particles and a liquid collecting zone the liquid collecting zone having pump means therein for transferring collected liquid to the holding tank.

Preferred embodiments of the invention will hereinafter be described with reference to the accompanying drawings in which.

Figure 1:
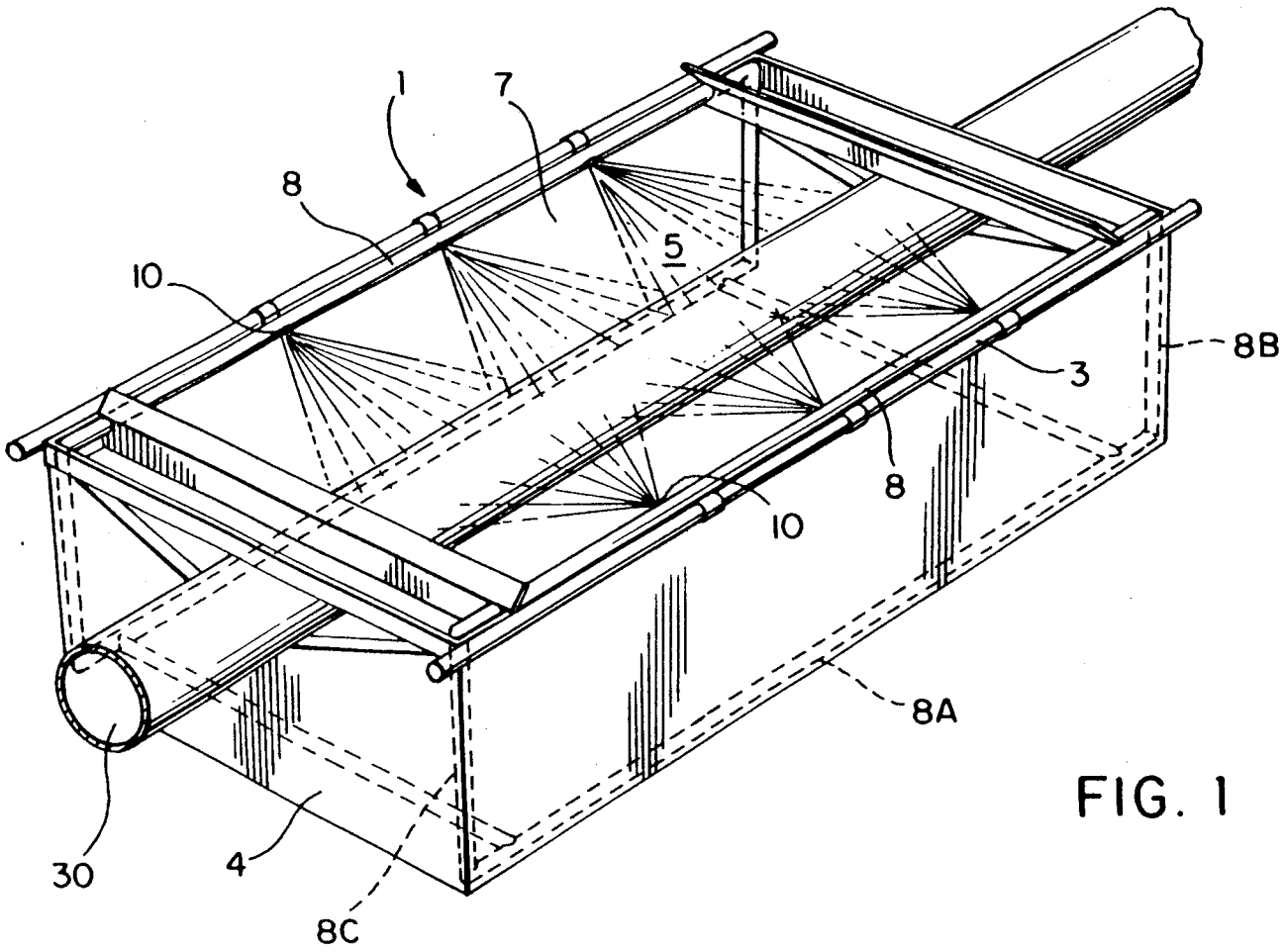
FIG. 1 is a schematic perspective view of one form of apparatus according to the invention.
Figure 2:
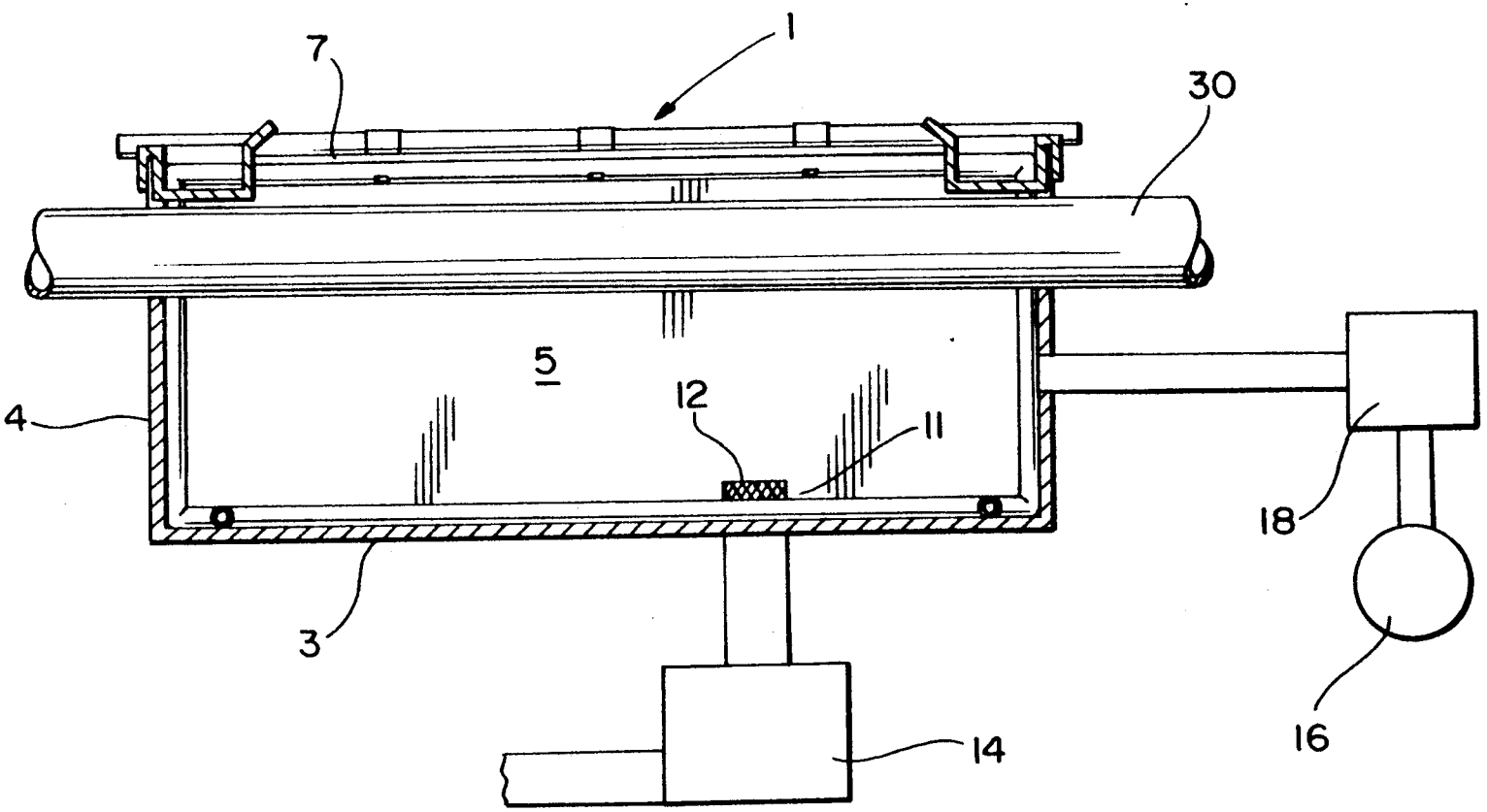
FIG. 2 is a side elevation of the apparatus shown in FIG. 1.

Referring to the drawings, the apparatus generally indicated at 1 comprises a main body in the form of a frame 3 and a containment or catchment screen 4 mounted thereto so as to define a work zone 5 therein. A pipe 30 which is to have the asbestos removed therefrom extends through the work zone 5 between opposite ends and the apparatus is supported by the pipe being worked upon. Suitable anchoring means may be provided to prevent the apparatus from twisting or moving when the pipe is being worked upon. An access opening 7 is provided in the top of the main frame through which the operator can access the part of the pipe to be worked upon.

Spray means in the form of a series of separate configurations such as the configuration 8 as shown is provided each configuration comprising a plurality of spray heads 10 arranged so that the fluid spray discharged therefrom defines a fluid barrier or curtain when in operation. The spray heads are connected to header pipes 11 which are operatively connected to a suitable source.

Other configurations as shown at 8A, 8B and 8C are provided along the base and the four side walls. These configurations also comprise a plurality of spray heads preferably connected to the same source as for the primary configuration.

A discharge outlet 11 having a grating 12 is disposed in the base of the main body which is operatively connected to a drain via a sand filter 14. The outlet provides for discharge of the fluid from the catchment screen 4. A vacuum pump 16 is operatively connected to the work zone 5 via an interceptor 18. The vacuum pump in operation reduces the pressure within the work zone and inhibits material leaving the work zone.

In operation, the frame 3 is secured to the pipe being treated. Any suitable clamping means may be used. The catchment screen 4 is then fitted to the frame and the spray heads 10 operatively connected to a fluid source and the vacuum pump 16 operatively connected to the work zone. The spray means and vacuum pump are then actuated and balanced flows effected to create the spray barriers. The operator who is preferably dressed in protective clothing passes hands through the access opening which is protected by the fluid barrier to treat the material. The material being treated may be collected and bagged in the work zone or passed through a chute to a bagging station. Not only does the spray provide an effective seal around the work zone but in the case of asbestos, wets the material down to render it less dangerous to handle.

Figure 3:
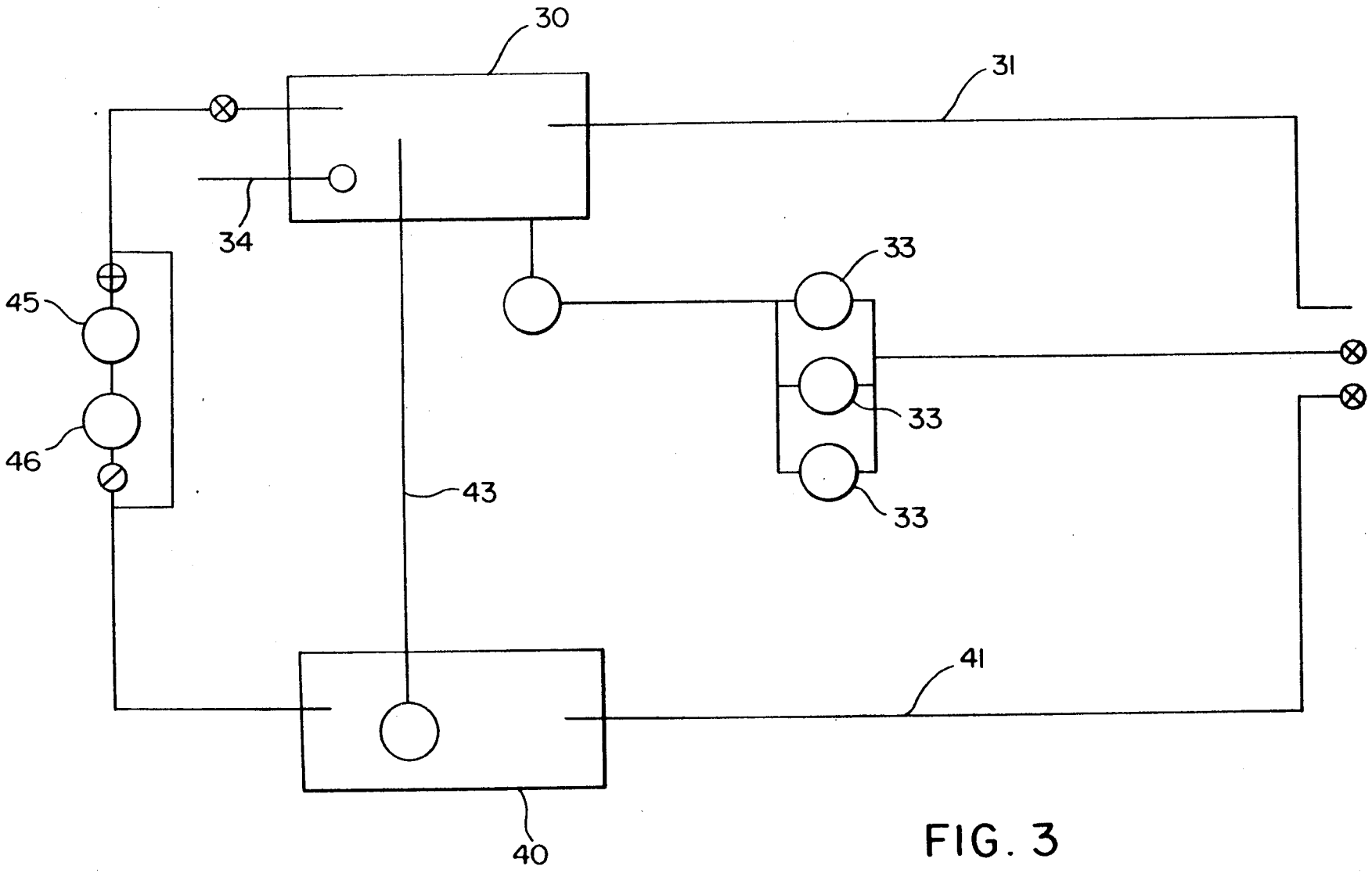
FIG. 3 is a block diagram of a plant layout suitable for use with the apparatus shown in FIGS. 1 and 2.

The apparatus of the present invention is suitable for use with a plant as shown in FIG. 3. Liquid which has formed the spray barriers is collected in carrier bag 4 and discharged through drain 12 where it passed to holding tank 30 through line 31. The liquid is filtered in a suitable manner (which will be described in more detail later) and is thereafter transferred to a pressure pump 32 which delivers the high pressure liquid to the spray heads of the apparatus. The pressurized liquid is passed through a series of filters 33, before returning to the spray heads. These filters 33 are arranged in parallel so that if one should fail the liquid can still be fed to the spray heads. A make-up liquid line 34 provides make-up liquid as required.

The plant further includes an interceptor 40 which receives liquid/solid/dust particles drawn from the work zone by the vacuum pumps through line 41. The material is filtered through a series of filter units and is delivered to a liquid collecting zone. The liquid collected in this zone is transferred to the holding tank 30 via line 43. The filtered gas is passed to the vacuum pumps 45 and 46 where final filtering is effected.

Figure 5:
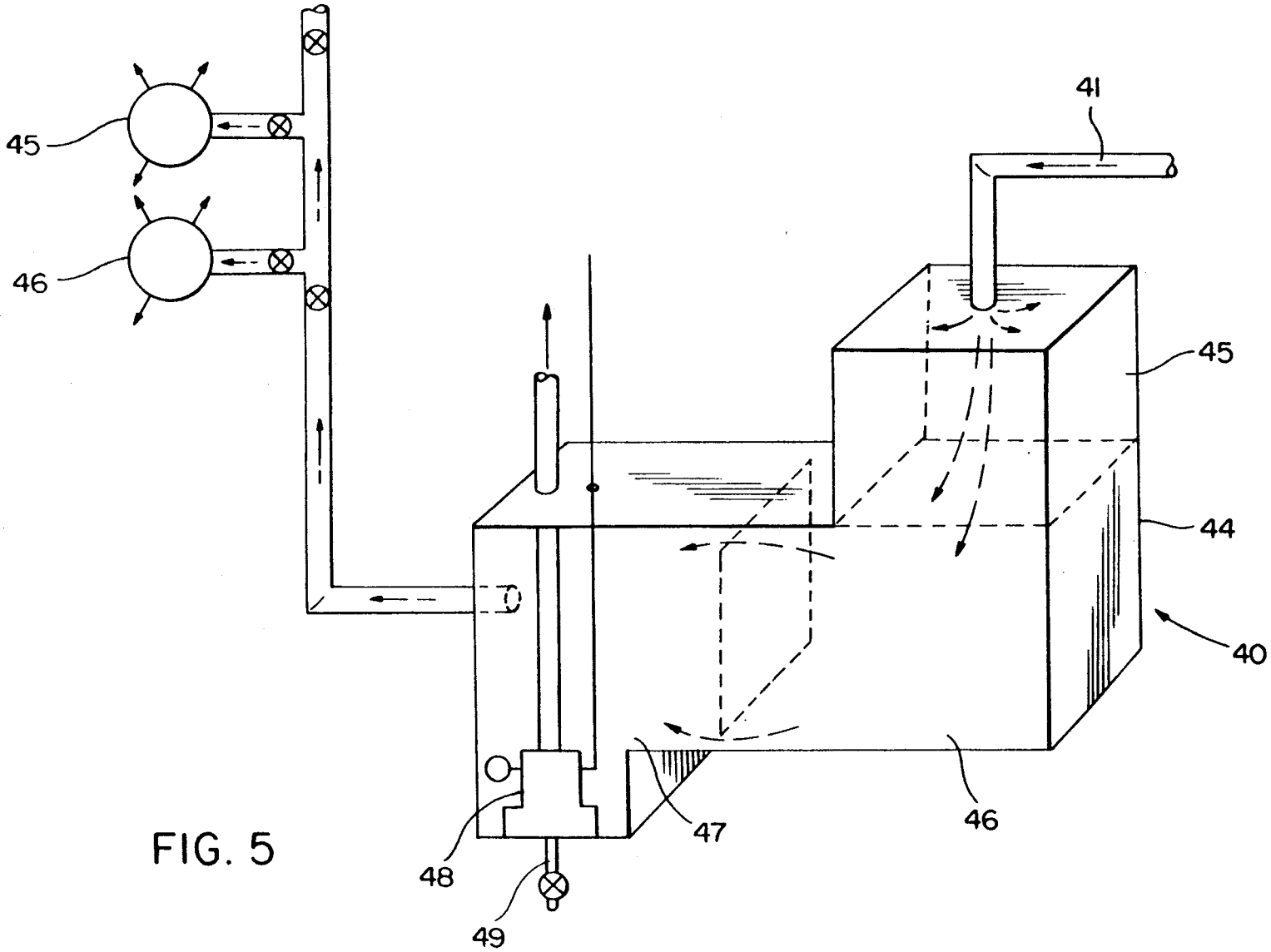
FIG. 5 is a schematic drawing of a liquid handling device for use in the plant layout shown in FIG. 3.

Referring to FIG. 5 the interceptor 40 comprises a vessel 44 which is separated into a pre-filter zone 45 which collects any solid particles from the incoming stream, a second filter zone 46 which separates liquid from the stream. The liquid is transferred to a liquid collecting zone 47. In this zone 47 a submersible pump 48 is disposed the pump having a control which is activated when the liquid level in the zone reaches a preselected level. The liquid is thereafter transferred by the pump to the holding tank 30. The gases passes through the interceptor 40 to the vacuum pumps 47 and 46 where final filtering of the dust is effected. A drain 49 may be provided to drain the liquid collecting zone as required.

Figure 4:
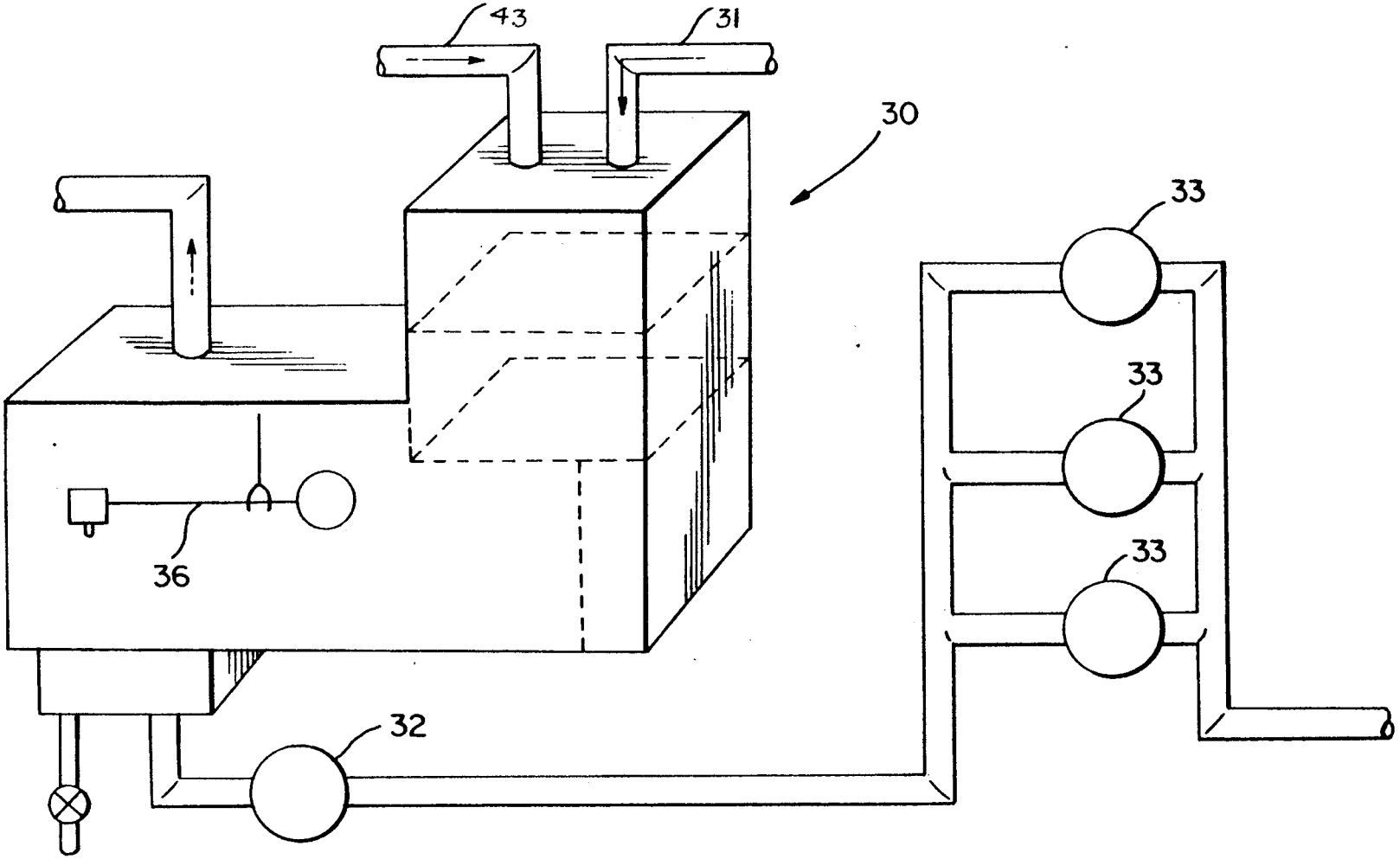
FIG. 4 is a schematic drawing of a liquid/dust/solids separator suitable for use in the plant layout shown in FIG. 3.

Referring to FIG. 4 the holding tank comprises a series of filter zones for separating solids from the liquid. The filtered liquid is held in a holding zone where it can be drawn off by pressure pump 32. A valve mechanism 36 is disposed within the holding zone to permit the selective entry of make-up liquid to the holding zone. The pressure pump 32 delivers high pressure liquid to the apparatus via a bank of filters 33. The holding table is operatively connected to the vacuum pumps to maintain the interior thereof at a slightly lower pressure.

I claim:

1. Apparatus for handling potentially dangerous materials by an operator, comprising;

a main body portion having a work zone therein, the work zone being bounded by a top, sides and a bottom, into which, in use, the material can be placed;

an opening for providing access to said work zone by said operator from externally thereof;

liquid spray means operatively mounted to said main body and operatively connectable to a liquid source, said liquid spray means comprising a plurality of spray heads arranged so that liquid spray therefrom forms a plurality of liquid barriers or curtains at the top and sides of the work zone including a liquid barrier or curtain across said access opening which at least partially surround said work zone to prevent escape of the potentially dangerous material from said work zone and configured so that at least part of the liquid spray produced by one or more of the liquid spray heads enters the work zone so as to wet the material therein, and means for maintaining a pressure differential between said work zone and externally thereof so that the pressure within the work zone is less than the pressure externally thereof when the apparatus is in use.

2. Apparatus according to claim 1, wherein the body portion comprises a frame comprising a plurality of elongated elements the frame being adapted to support the liquid spray means, and a catchment section for collecting fluid discharged by the liquid spray means, the catchment section also collecting material being worked upon in the work zone.

3. Apparatus according to claim 2, wherein the catchment section comprises a flexible screen which is suspended from the frame of the main body.

4. Apparatus according to claim 3, further including a discharge outlet from which the liquid can be discharged from the work zone.

5. Apparatus according to claim 4, further including a holding tank operatively connected to said discharge outlet, filter means within said holding tank for filtering solid particles from the liquid and pump means for returning liquid to the spray means.

6. Apparatus according to claim 1, wherein said liquid spray means comprises a primary configuration which includes one or more spray heads which are adapted so that in use the liquid spray forms a barrier or curtain across the access opening to the work zone and one or more additional configurations comprising one or more liquid spray heads, the or each spray head in each additional configuration being adapted in use so that the liquid spray pattern forms a liquid barrier or curtain at selected peripheral planes about the work zone.

7. Apparatus according to claim 1, wherein said means for maintaining a pressure differential between the work zone and externally thereof comprises a vacuum pump which is operatively connected to the work zone.

8. Apparatus according to claim 7 further including an interceptor for receiving liquid/solid/dust particles drawn from the work zone by said vacuum pump, said interceptor including a pre-filter zone for collecting solid particles, a second filter zone for separating the liquid in the stream from the solid particles in a liquid collecting zone, said liquid collecting zone having pump means therein for transferring collected liquid to said holding tank.

9. Apparatus according to claim 1, wherein the liquid spray heads forming at least one of said liquid barriers or curtains comprises two groups of liquid spray heads, the groups of the liquid spray heads being spaced apart from one another with the liquid spray heads of one group facing towards the liquid spray heads of the other group so that the spray omitted from the two groups comes into collision.

10. Apparatus according to claim 1, wherein the liquid barriers or curtains are arranged to completely enclose the work zone.

* * * * *